US007143484B2

(12) United States Patent
Lee

(10) Patent No.: US 7,143,484 B2
(45) Date of Patent: Dec. 5, 2006

(54) SWIMMING GOGGLE BUCKLE

(75) Inventor: Tony Lee, Taipei Hsien (TW)

(73) Assignee: First Rank Co., Ltd., Taipei Hsien (TW)

( * ) Notice: Subject to any disclaimer, the term of this patent is extended or adjusted under 35 U.S.C. 154(b) by 0 days.

(21) Appl. No.: 10/909,415

(22) Filed: Aug. 3, 2004

(65) Prior Publication Data

US 2006/0026804 A1 Feb. 9, 2006

(51) Int. Cl.
*A61F 9/02* (2006.01)

(52) U.S. Cl. ..... 24/199; 2/452

(58) Field of Classification Search ..... 2/452; 351/43, 156; 24/318, 321, 323, 324, 199
See application file for complete search history.

(56) References Cited

U.S. PATENT DOCUMENTS 5,581,822 A * 12/1996 Tagyo ..... 2/428
6,317,897 B1 * 11/2001 Chiang ..... 2/428
6,721,963 B1 * 4/2004 Kawashima ..... 2/426

* cited by examiner

*Primary Examiner*—James R. Brittain
(74) *Attorney, Agent, or Firm*—Troxell Law Office, PLLC

(57) ABSTRACT

A swimming goggle buckle includes a goggle main body, two single buckle complexes, and a headband, wherein the goggle main body includes a nose pad, a rim, face contacting pads, a glass lens formed in the rim, and an opening formed at each end. One end of each single buckle complex is fastened at an opening thereof and the other end connecting to the headband, thereby enabling the goggle buckle to be easy to assemble, difficult to disassemble, convenient to adjust, while still containing relatively few individual parts.

3 Claims, 7 Drawing Sheets

SWIMMING GOGGLE BUCKLE

BACKGROUND OF THE INVENTION (a) Field of the Invention

The present invention relates to an improvement of a swimming goggle buckle, having a goggle main body, two single buckle complexes, and a headband, wherein each single buckle complex connecting with an end of the goggle main body at one end and with the headband at another end. The present invention is easy in assembling, difficult in disassembling, and convenient in adjusting the headband. In addition, special considerations in design were provided for the single buckle complex by utilizing a single model, having an upper and a lower model adhering together, which eliminating mechanic structures therein, thereby reducing modeling cost, enhancing modeling strength, and lowering failure rate during production. As a result, the single model enabling the present invention lowering cost, increasing durability, and enhancing competitiveness.

(b) Description of the Prior Art

The main defect of a conventional swimming goggle is that some elements are formed by two separate elements combining together, which can be inferior in strength and also complicated in manufacturing, comparing with that of a single element.

Referring to FIGS. 1A and 1B. A conventional swimming goggle includes a goggle main body a with an extension strap a1 connecting to each end, wherein a block b, formed by combining an element b1 and an element b2, connecting to an end a2 of the extension strap a1 and a headband c formed inside the block b. The conventional swimming goggle thereof involves two elements combined to form the block b, being an inferior structure in strength, and also has many parts, which complicating assembling, causing much trouble, and increasing cost in production.

Referring to FIG. 1C. Another conventional swimming goggle is formed by joining a buckle d to an extension strap a by blow-modeling of the buckle d embedded in a model of the extension strap a, which improves strength but with an adverse effect of increasing failure rate during production when combining the buckle d with the extension strap a in a model. Besides, the headband c is a two-element structure, too.

SUMMARY OF THE INVENTION

It is an objective of the present invention to provide a buckle structure formed at both ends of a goggle main body, being modeled in a single body, enabling easy in assembling, difficult in disassembling, and convenient in adjusting headband, as well as lowering cost, increasing durability, and enhancing competitiveness.

It is another objective of the present invention to provide the buckle structure to prevent looseness and distortion and increasing comfort when wearing.

To achieve objectives hereinabove, the present invention includes a single buckle complex formed at each end of a goggle main body, wherein a cantilever structure formed in the front fastening the goggle main body and also preventing looseness and distortion, a barb structure formed in the middle enhancing fastening capability and making unintentional disassembly more difficult, and a shaped buckle (i.e. a buckle having two spaced crossbars) to form three spaced openings with a gap formed in the rear fixing a headband while also facilitating headband adjustment through the gap.

The single buckle complex, possessing functions of connection, adjustment, and fastening after assembling, works by fastening the III-shaped buckle in the rear to the headband and by inserting an end of the goggle main body from the bottom of the cantilever structure and further hooking at the barb structure thereof, wherein, the III-shaped buckle fastening the headband while also with the gap facilitating headband adjustment, a surface of the goggle main body contacting tightly against a base of the cantilever structure enabling the single buckle complex fixing on the goggle main body when the headband being tightened, which preventing looseness and distortion as well as increasing comfort when wearing, and the barb structure making the disassembling work hard and also enhancing fastening capability.

With the single buckle complex forming separately with the goggle main body, the production failure rate can then be lowered, thereby increasing the production success rate.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1B:
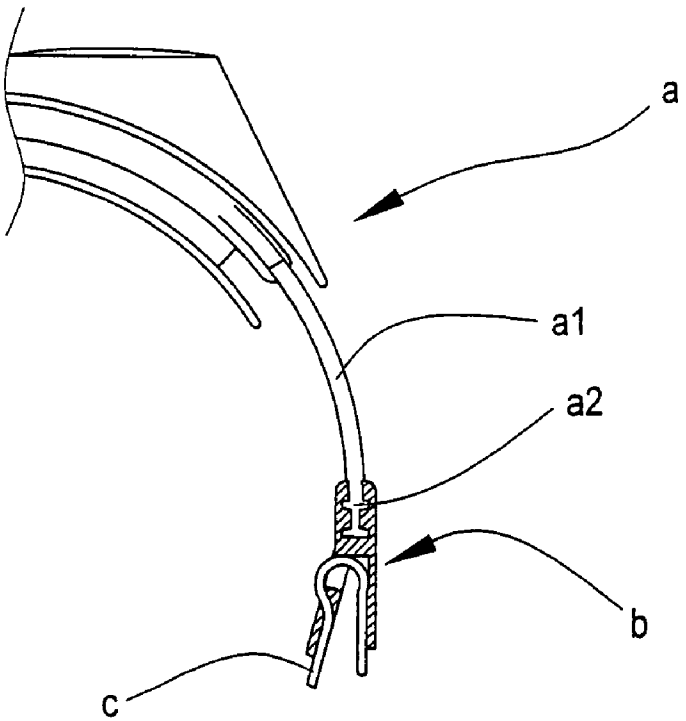
FIG. 1B ( PRIOR ART )
FIG. 1 shows an exploded elevational view of a conventional goggle.
Figure 1A:
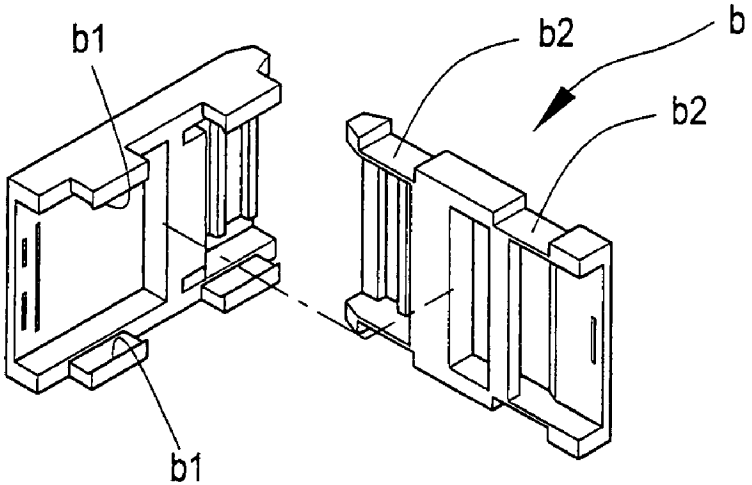
FIG. 1A ( PRIOR ART )
Figure 1C:
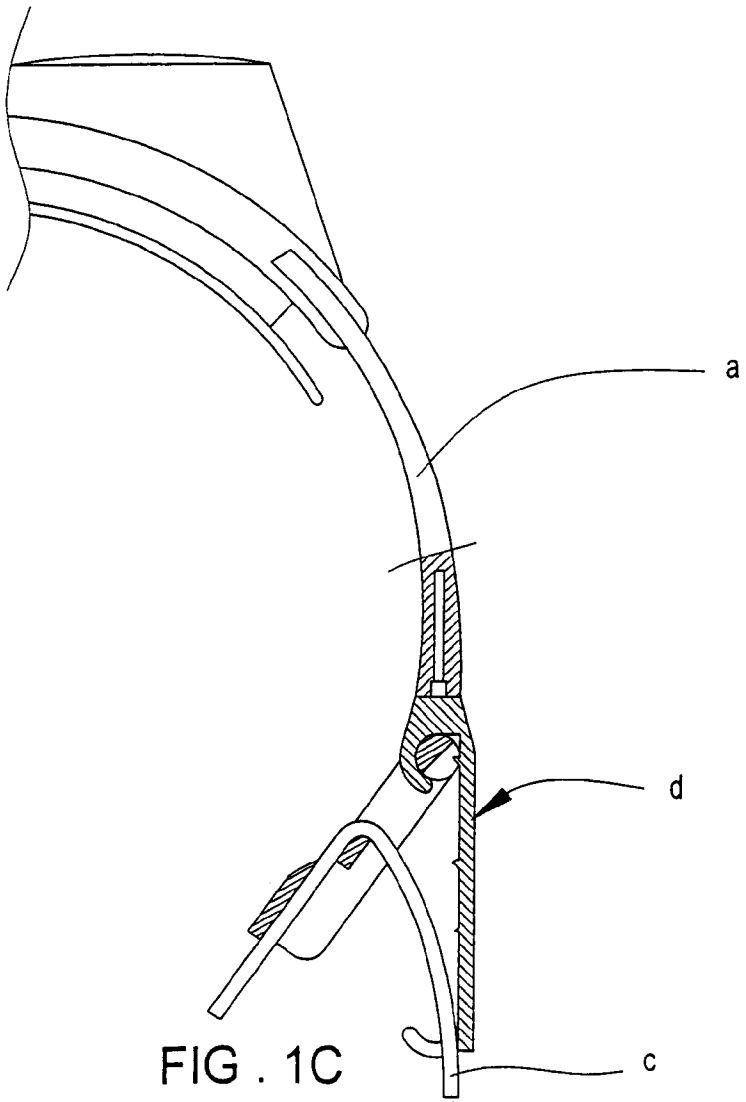
FIG. 1C ( PRIOR ART )
Figure 2:
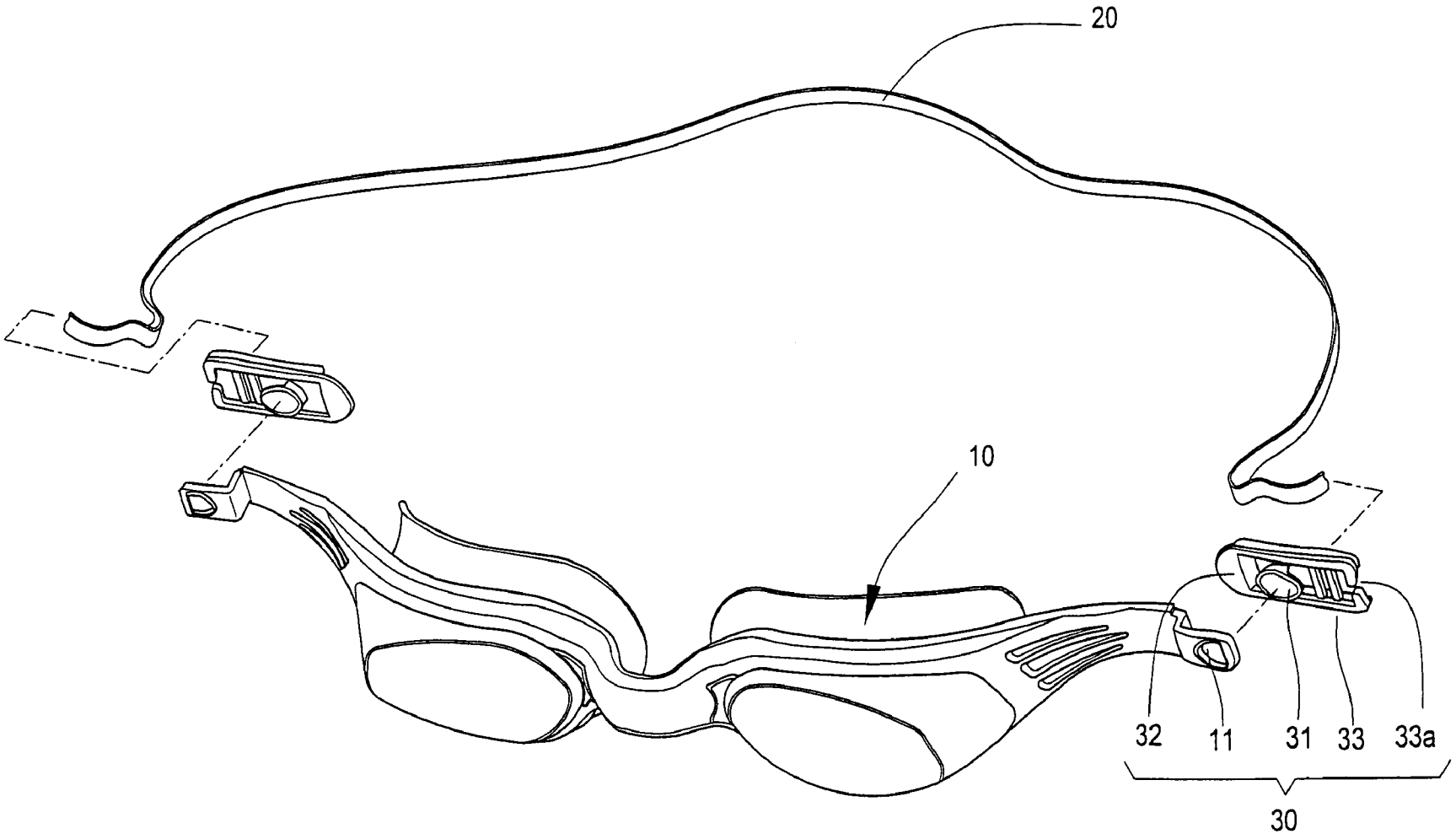
FIG. 2 shows an exploded elevational view of the present invention.
Figure 3:
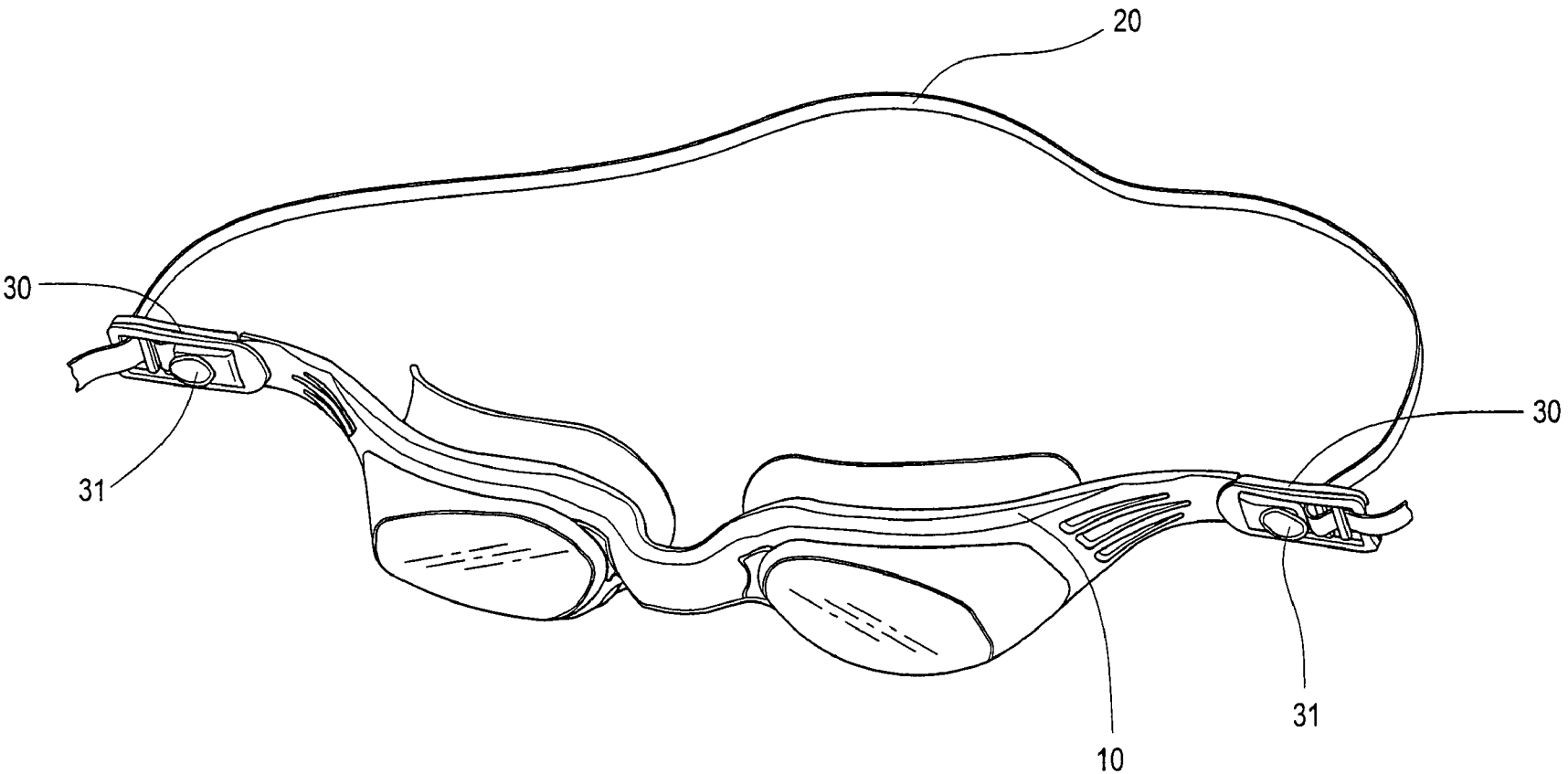
FIG. 3 shows an exploded elevational view of the present invention.
Figure 4A:
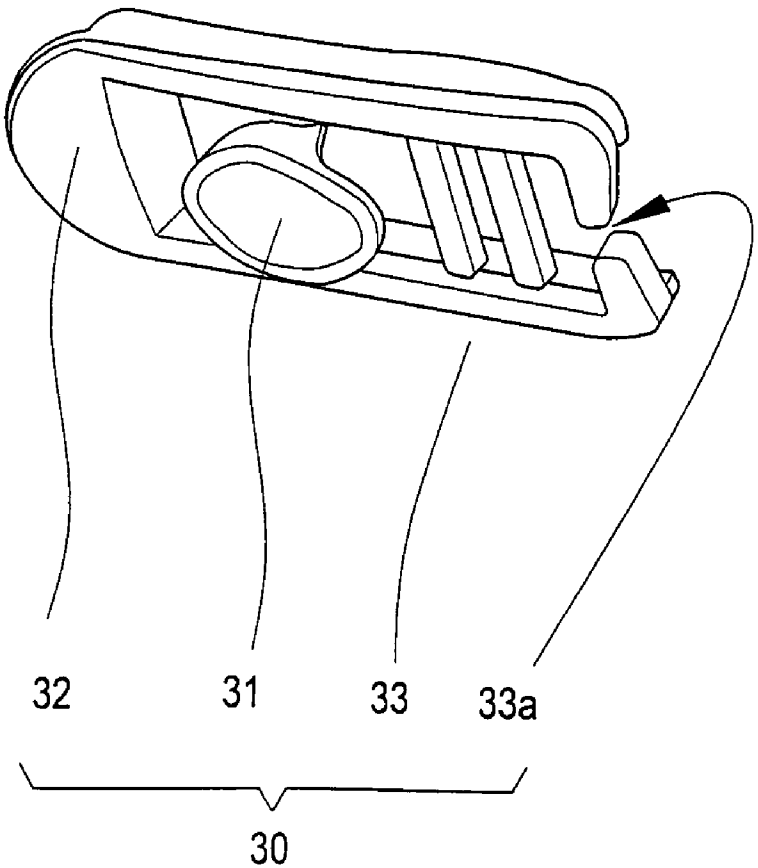
FIG. 4A shows a perspective view of a single buckle complex of the present invention.
Figure 4B:
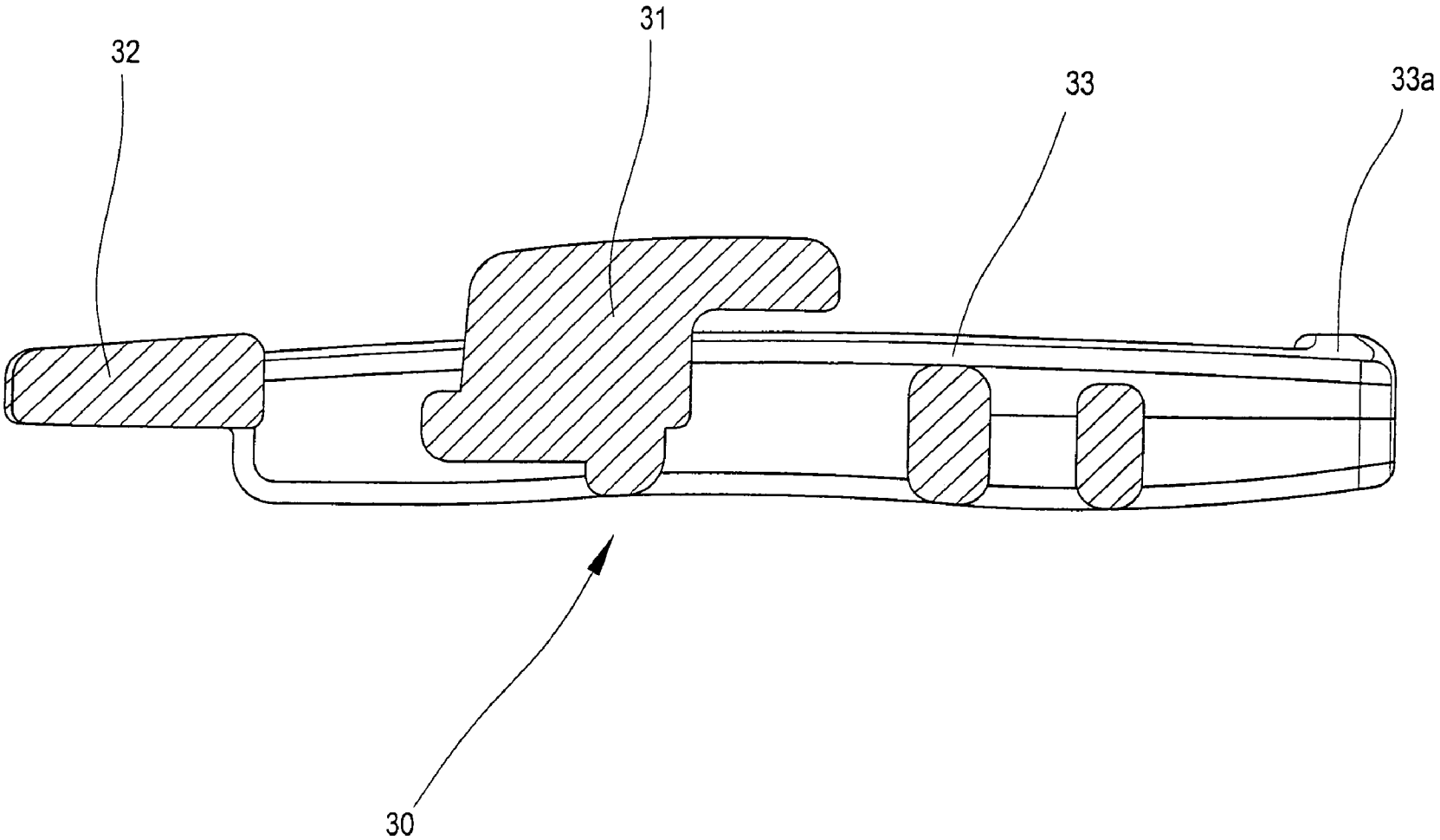
FIG. 4B shows a cross-sectional view of a single buckle complex of the present invention.

Referring to FIGS. 2 and 3. The represent invention is an improvement of a swimming goggle buckle, including a goggle main body 10, a headband 20, and two single buckle complexes 30, wherein, the goggle main body 10 including a nose pad, a rim, glass lens, and face contacting pads, as well as openings 11 at both ends, each single buckle complex 30 connecting with the goggle main body 10 at one end and with the headband 20 at another end, and the headband 20 being formed by a kind of elastic material. Referring to FIGS. 4A and 4B. The single buckle complex 30 is formed with a barb structure 31 in the middle, a cantilever structure 32 in the front, a shaped buckle 33 in the rear, and a gap 33*a* at an end portion of the shaped buckle 33.

Figure 5:
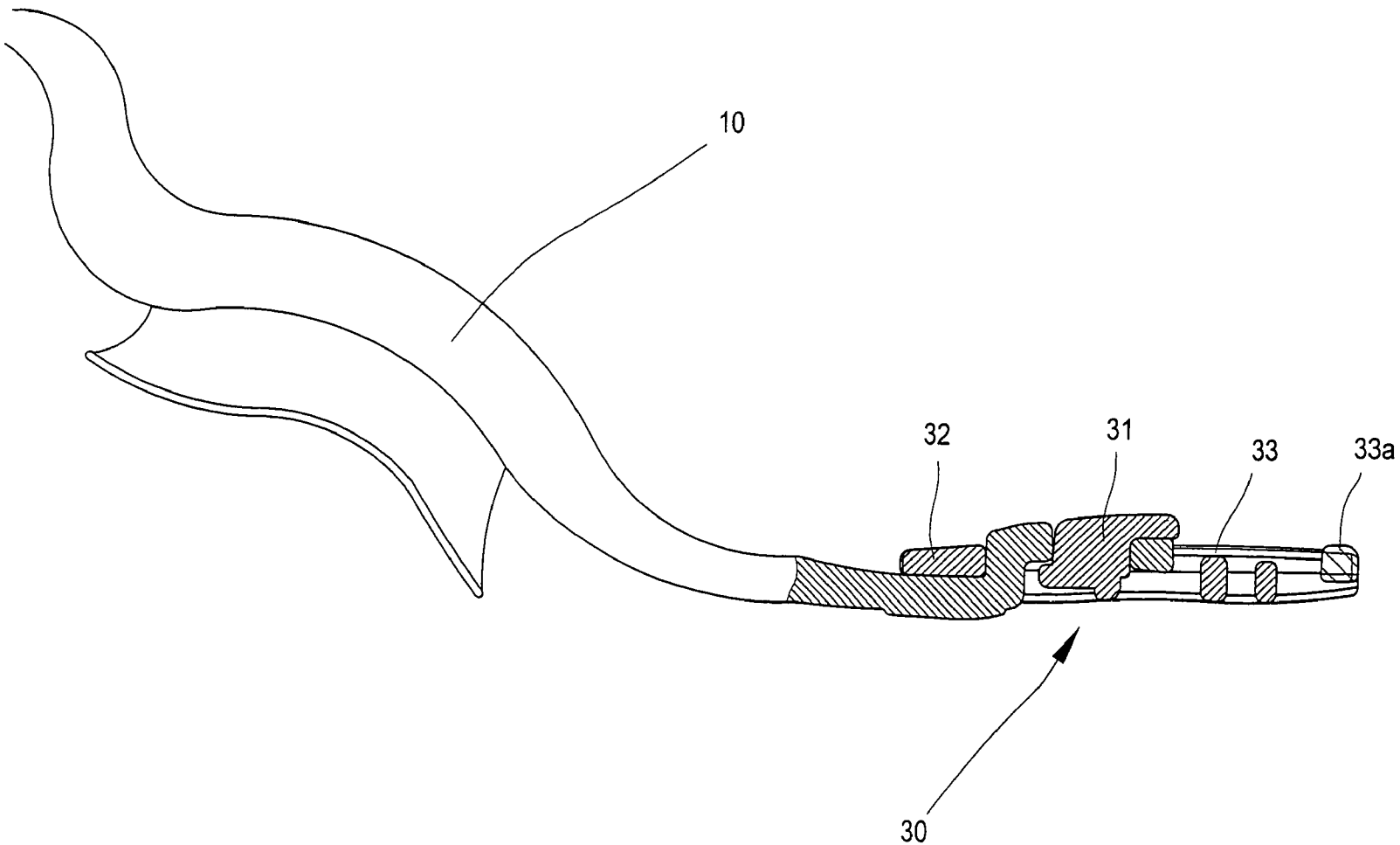
FIG. 5 shows a cross-sectional view of a single buckle complex buckling with a goggle main body of the present invention.

Referring to FIG. 5. By inserting an end of the goggle main body 10 from the bottom of the cantilever structure 32 to hook the opening 11 at the barb structure 31 thereof, the goggle main body 10 thereby contacting tightly against the base of the cantilever structure 32 when the headband being tightened, enabling the single buckle complex 30 fixing on the goggle main body 10 to prevent looseness and distortion and to increase comfort when wearing. Meanwhile, the III-shaped buckle 33 in the rear fastens the headband 20 while also with the gap 33*a* to facilitate adjustment of the headband 20.

In summary, the present invention of the swimming goggle buckle, having a goggle main body and single buckle complexes connected with a headband, is easy in assembling, difficult in disassembling, and convenient in adjusting headband, besides having functions in preventing looseness and distortion and increasing comfort when wearing. Thereby, the present invention is both practical and advanced.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A swimming goggle structure, comprising:

a goggle body;

a headband; and two single buckle complexes wherein each of the two single buckle complexes comprises a single piece body including:

a perimeter member forming an open interior space, the perimeter member being continuous around the perimeter of the buckle complex except for a gap at a distal end, the perimeter member forming a cantilevered portion at a proximal end;

two crossbars spanning the open interior space for receiving the headband; and a barb located in the open interior space between the cantilever portion and the two crossbars, the barb having a hooking portion configured for hooking through an opening in the goggle body to removably secure the buckle complex to the goggle body, the hooking portion being configured to extend away from a user when the swimming goggle structure is worn by a user.

2. The swimming goggle structure according to claim 1 wherein the goggle main body, being formed in a single body, comprising a nose pad, a rim, and face contacting pads.

3. The swimming goggle structure according to claim 1 wherein the headband being made of elastic material.

* * * * *